US007056142B2

(12) United States Patent
Ueda

(10) Patent No.: US 7,056,142 B2
(45) Date of Patent: Jun. 6, 2006

(54) LOCKING STRUCTURE FOR CONNECTOR

(75) Inventor: Hirohisa Ueda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/412,286

(22) Filed: Apr. 14, 2003

(65) Prior Publication Data

US 2003/0194899 A1 Oct. 16, 2003

(30) Foreign Application Priority Data

Apr. 15, 2002 (JP) ..... 2002-111614
Apr. 16, 2002 (JP) ..... 2002-112952

(51) Int. Cl.
*H01R 13/627* (2006.01)

(52) U.S. Cl. ..... 439/358; 439/328

(58) Field of Classification Search ..... 439/328, 439/357, 358

See application file for complete search history.

(56) References Cited

U.S. PATENT DOCUMENTS 4,272,145 A 6/1981 LaDuke
4,801,275 A * 1/1989 Ikeda et al. ..... 439/350
5,203,719 A * 4/1993 Kozono ..... 439/489
5,624,272 A 4/1997 Ohsumi
5,938,470 A * 8/1999 Kashiyama ..... 439/489
6,146,183 A * 11/2000 Jinno et al. ..... 439/358

FOREIGN PATENT DOCUMENTS

EP 1 001 498 A2 5/2000
EP 1 133 019 A2 9/2001
JP 59-279 1/1984

* cited by examiner

*Primary Examiner*—Thanh-Tam Le
(74) *Attorney, Agent, or Firm*—Armstrong, Kratz, Quintos, Hanson & Brooks, LLP

(57) ABSTRACT

A locking lever is formed to include a pair of legs 16 upright from the wall of a first connector 10 and a pair of free ends 17 which continuously cross the pair of legs and provide a locking portion 18. A releasing lever 20 is formed to return to the legs from the free ends 17. A second connector 40 is provided with a hitting portion which hits against the end of the second connector 40. When the releasing lever is pushed, the free ends 17 are lifted by the theory of leverage at the furculum of the hitting portion, thereby releasing the locking between the engagement portions 18, 50. The releasing lever 20 includes a pair of arms 21 and a pressing portion 23 which continuously crosses the pair of arms. This configuration provides a connector locking structure which can prevent the base of the locking lever from being deformed and improve the feeling of clicking in coupling and capability of releasing the locking.

11 Claims, 5 Drawing Sheets

LOCKING STRUCTURE FOR CONNECTOR

BACKGROUND OF THE INVENTION

Field of the Invention

This invention relates to a locking structure for holding the coupled state between one connector, which is connected to an electric wire for making the transfer between instruments loaded in a vehicle, and the other connector, which is directly anchored to a circuit board.

Various connector locking structures have been proposed for coupling a connector serving as a connecting component which supplies electric power to various instruments for the vehicle and gives a control signal to them and a complementary component and holding the coupled state of both connectors. Typical examples thereof will be explained below.

There is a seesaw type locking structure in a T-shape. As seen from FIG. 9, this type locking structure includes a stem 72 which stands from a wall 71 of a connector 70 and a releasing lever 73 and locking lever 74 on both sides of the stem 72. By engaging a locking hole 75 made in the locking lever 74 with the complementary connector (not shown), the fitting state of both connectors is held. In order to release the coupling, the releasing lever 73 is depressed. However, this locking structure has a defect that the capability of releasing the coupling is poor since the locking lever 74 is difficult to be deformed.

There is also a cantilever locking structure. In this locking structure, by engaging an engagement portion located at the free end on the one side of a connector with an engagement portion of a complementary connector, the coupled state of both connectors is held.

An example of the cantilever type connector locking structure is disclosed in J-UM-59-279. As seen from FIG. 10, a pair of stems 82 stand on the wall 81 of a connector 80. A ⊐-shape releasing lever 83 includes a pair of arms 84 which are communicated with the stems 82 and are in parallel to each other and a pressing portion 85 which continuously cross the pair of arms 84. The one end of the arm 84 communicates with the stem 82 serving as a fixed end whereas the other end thereof communicates with the pressing portion 85.

A locking hole 88 is formed at the tip 87 of a flexible locking lever 86 which is formed to protrude from the pressing portion 85 of the releasing lever 83. The locking lever 86 serving as a free end extends out further in a direction of being coupled with a complementary connector (not shown) than the pair of stems 82. The base of the locking lever 86 serves as a fixed end.

In operation of the above configuration, when the connectors are coupled with each other so that the locking hole 88 of the locking lever 86 is engaged with the locking projection (not shown) of a complementary connector, the coupled state of the connectors is held.

In order to separate the connectors from each other, the releasing lever 83 is pressed by a finger so that the pair of arms 84 are elastically deformed and the tip 87 of the locking lever 86 is pushed up. In this way, the engagement between the locking hole and engaging projection is released and the connectors are separated from each other.

However, the conventional connector locking structure presents the following problem to be solved.

First, when the locking lever 74, 86 is elastically deformed, stress is concentrated to the base 76, 89 which is the fixed end so that the base 76, 89 may be plastically deformed. In the seesaw type or cantilever type locking structure, when the locking lever is warped, the stress is concentrated on the base 76, 89 to some extent. Particularly, where the protruding length is short (FIG. 9), the locking lever 74 is difficult to warp, it must be bent strongly. As a result, the bending stress acted on the base 76 increases so that deformation becomes likely to occur on the base 76. When the base 76 is subjected to plastic deformation, an coupling margin between the locking hole 75 and locking protrusion decreases so that the coupling is likely to be released.

Specifically, where the protruding length of the locking lever is short, the locking holding force is great and the feeling of click when the coupling is made is good. Nevertheless, the locking lever 74 is difficult to warp, the assembling capability is poor and the stress acted on the base 76 becomes great.

On the other hand, where the protruding length is long (FIG. 10), the locking lever 86 which serves as the free end is easy to warp, the assembling capability is good and the stress acted on the base 89 becomes small. But, the locking holding force is likely to become small. If the locking holding force is small, the feeling of click when the locking is made is lost. Therefore, although the coupling is incomplete, an operator may misunderstand that the coupling has been completely made.

In view of the above fact, the protruding length of the locking lever 74, 86 must be set considering the balance among the assembling capability, the strength of the base and the coupling holding force. However, the conventional connector locking structures described above cannot satisfy the above requirements simultaneously.

Secondly, there is also a problem that the operability when the coupling between the locking hole 75, 88 and the locking protrusion is released is poor. Specifically, as the case may be, even when the releasing lever 73, 83 is operated, the locking lever 74, 86 is not lifted so that the coupling cannot be released.

Further, because the releasing lever 73, 83 protrude outwardly from the wall 71, 81 of the connector 70, 80, owing to interference with the outside, the releasing lever 73, 83 is inadvertently depressed to release the coupling between the connectors. Further, the locking lever 74, 86 having the locking hole 75, 88 is caught in the outside to warp so that the coupling may be released.

Therefore, a first object of this invention is to provide a connector locking structure which can prevent a base of a locking lever from being deformed, improve the feeling of click in coupling and improve the releasing capability of coupling.

Meanwhile, in the connector locking structure shown in FIG. 9, although the locking lever 74 and the releasing lever 73 are short, respectively, the entire arm 78 inclusive of both levers is relatively lengthy. In the connector locking structure shown in FIG. 7 also, although the releasing lever 83 is short, the entire arm 90 inclusive of both locking lever 86 and the releasing lever 83 is relatively lengthy. Thus, the locking portion of these connector locking structures becomes large-scaled disadvantageously.

Therefore, a second object of this invention is to provide a connector locking structure which can surely make coupling/decoupling between the connectors without large-scaling the locking portion.

In order to attain the first object, there is provided a connector locking structure for holding the coupled state of first and second complementary connectors each equipped with an engagement portion, wherein the first connector comprises:

a locking lever including a pair of legs upright from a lower wall of the first connector and a pair of free ends which continuously cross the pair of legs and coupled with each other to provide the engagement portion, and a releasing lever formed to return to the legs from the free ends.

In this configuration, the engagement portions of the first and second connectors are engaged with each other so that the coupling between the connectors is held to make electric connection. Since the engagement portion of the first connector is provided at the free ends which continuously cross the pair of legs which are fixed ends, the locking holding force can be held. In addition, the force acted on the legs when the free ends are warped is resolved in two directions so that the bending stress for the legs is reduced, thereby preventing the legs from being deformed. Further, since the releasing lever is provided so as to return from the free ends to the legs in U-turn shape, the releasing lever is likely to warp. Therefore, by depressing the releasing lever by a finger, the engagement between the engagement portions can be easily released.

Preferably, the second connector is fit between the lower wall of the connector and the free ends thereof, and when the releasing lever is depressed, a hitting portion of the releasing lever hits against a front end of the complementary connector and operates as a fulcrum of leverage so that the free ends are lifted, thereby releasing the coupling state between the coupling portion and the engagement portion.

In this configuration, in the coupled state of the connectors, when the releasing lever is depressed, a hitting portion of the releasing lever hits against a front end of the second connector and operates as a fulcrum of leverage so that the free ends are lifted. Therefore, the releasing lever can be operated by small force so that the engagement between the engagement portions can be easily released.

Preferably, the hitting portion is a portion which protrudes downward. In this case, since the hitting portion protrudes, when the releasing lever is depressed, the hitting portion can easily hit against the end of the second connector so that the theory of leverage is effectively operated, thus surely lifting the free ends.

Preferably, the releasing lever includes a pair of arms arranged outside or inside the pair of legs and a depressing portion which crosses to communicate with the pair of arms. In this configuration, where the releasing lever is located outside the pair of legs, the size of the releasing lever can be increased so that a finger can be easily placed on the depressing portion. Where the releasing lever is located inside the pair of legs, the releasing lever can be downsized.

Preferably, the pair of arms extend beyond the pair of legs in a direction opposite to a connector coupling direction. In this configuration, when the depressing portion arranged behind the legs is depressed, the free ends can be lifted by small force.

Preferably, at corners where the free ends intersect the releasing lever, a pair of operation portions are formed to press the outer wall of the second connector. In this configuration, when both engagement portions are engaged with each other, the operating potions strongly hit against the wall of the second connector. Thus, the feeling of clicking of engagement or locking can be obtained so that the misconception of engagement or locking can be prevented.

Preferably, the locking portion is an edge in a ⊐-shape formed by the free ends and the engagement portion of the second connector is a locking protrusion composed of a slope and locking face continuous thereto. In this configuration, when the ⊐-shape edge of the first connector climb onto the slope of the locking protrusion and climbs over the locking face, the ⊐-shape edge is elastically restored so that the ⊐-shape edge is locked by the locking face of the locking protrusion. Thus, the first and second connectors can be easily coupled with each other so that coupling workability can be improved.

Preferably, a protrusion for limiting warp is formed on the wall opposite to the depressing portion. In this configuration, because of provision of the protrusion, when the depressing portion is depressed, the depressing portion 23 is brought into contact with the protrusion, thereby stopping excessive elastic deformation of the releasing lever.

The depressing portion is preferably provided with a rib for preventing slippage. Therefore, when the depressing portion is depressed by a finger, slippage of the finger tip is prevented, thereby improving the operability of the releasing lever.

Protruding walls for stopping external interference is made to cover both ends of the depressing portion. In this case, the protruding walls can stop external interference so that the releasing lever is prevented from being pressed inadvertently. In other words, the external interference is prevented from being acted on the releasing lever so that inadvertent unlocking of the engagement portions can be prevented, thereby holding the coupling state of the connectors.

In order to attain the second object, there is provided a connector locking structure provided with a locking portion formed in a first connector and a portion-to-be-locked formed in a second connector so that both connectors are locked with each other simultaneously when they are engaged with each other, wherein the locking portion comprises:

a first arm which is upright from the lower wall of the first connector, a second arm which extends from the free end of the first arm toward the upright base of the first arm and has a contact fulcrum for a wall of the second connector, an engagement portion located on the side of the free end of the first arm, and an operating portion for lock-releasing which is upright on the side of the free end of the second arm.

In this configuration, in coupling both connectors with each other, when the free end of the locking portion of the first connector is pressed by the portion-to-be-locked of the second connector in a warping direction, the engagement portion is engaged with the portion-to-be-locked while the first arm warps at a fulcrum of the upright base. Simultaneously, the first arm is restored to the original state so that both connectors are coupled with each other with no come-off. The engagement portion serves as an operating point.

In releasing the coupling between both connectors, when the operating portion is pulled or pushed in a longitudinal direction of the first and second arms, i.e. in a direction crossing the protruding direction of the operating portion, the second arm warps in the lock-releasing direction at a fulcrum of the contact between the wall of the second connector and the second arm and the engagement portion moves in the locking releasing direction unitarily with the second arm so that the locking between the engagement portion and the portion-to-be-locked is released. In this case, the operating portion serves as a power point. With the locking released, by pulling the first connector in the same direction as that of operating the operating portion, the coupling between both connectors is released.

The second arm extends toward the upright base of the first arm, but is not required to extend beyond the upright base (even if the second arm is short, the second arm can warp by the theory of leverage at the fulcrum of the contact between the wall of the second connector and the second arm. Therefore, the locking portion can be made compact in the longitudinal direction.

Preferably, the first arm and the second arm have approximately equal lengths and the operating portion is located beside and above the upright base.

In this configuration, since the operating portion extends beside and oppositely (upward) to the upright base of the first arm, in releasing the locking, by pulling or pushing the operating portion in the longitudinal direction of the arms, these arms can be warped easily and surely in the direction of releasing the locking by small force through the theory of leverage. It is needless to say that the locking portion can be made compact in the longitudinal direction because both arms has approximately equal lengths.

Preferably, a slit formed between the first and second arms extends toward the free end of the first arm beyond the engagement portion.

In this configuration, in coupling both connectors with each other, the first arm can be easily warped so that the locking can be made with small force. In releasing the locking, the second arm can be warped in the locking releasing direction with small operating force so that the operation of releasing the locking can be assured.

Preferably, the contact furculum is a slope. In this configuration, in coupling both connectors with each other, the tip of the wall of the second connector is brought into contact with the slope of the second arm. In releasing the locking, by pulling or pushing the operating portion in the direction crossing its protruding direction, the second arm can be warped surely with small force at the fulcrum of the slope by the theory of leverage so that the locking can be surely released.

Preferably, the first arm is one of a first pair of arms coupled with other through a first coupling portion, the second arm is one of a second pair of arms coupled with each other, and the operating portion is formed upright on the second coupling portion.

In this configuration, in connector coupling, the first pair of arms warp uniformly so that the engagement portion is engaged with the portion-to-be-locked of the second connector with strong engagement force between the first pair of arms. Further, the second pair of arms are supported stably on the side of the free ends of the first pair of arms. Therefore, in releasing the locking, the second pair of arms are warped simultaneously and with a large stroke by operating the operating portion so that the locking can be released easily and surely by small operating force.

Preferably, the first pair of arms are located outside whereas the second pair of arms are located inside.

In this configuration, the second pair of arms are located with an inner space between the outside first pair of arms, and the coupling portion and the operating portion of the second pair of arms are located inside the upright bases of the first arms. Only the operating portion protrudes upward the upright bases so that the locking portion can be made compact in the height direction.

The above and other objects and features of this invention will be more apparent from the following description taken in conjunction with the accompanying drawings.

DESCRIPTION OF THE PREFERRED EMBODIMENTS

Figure 1:
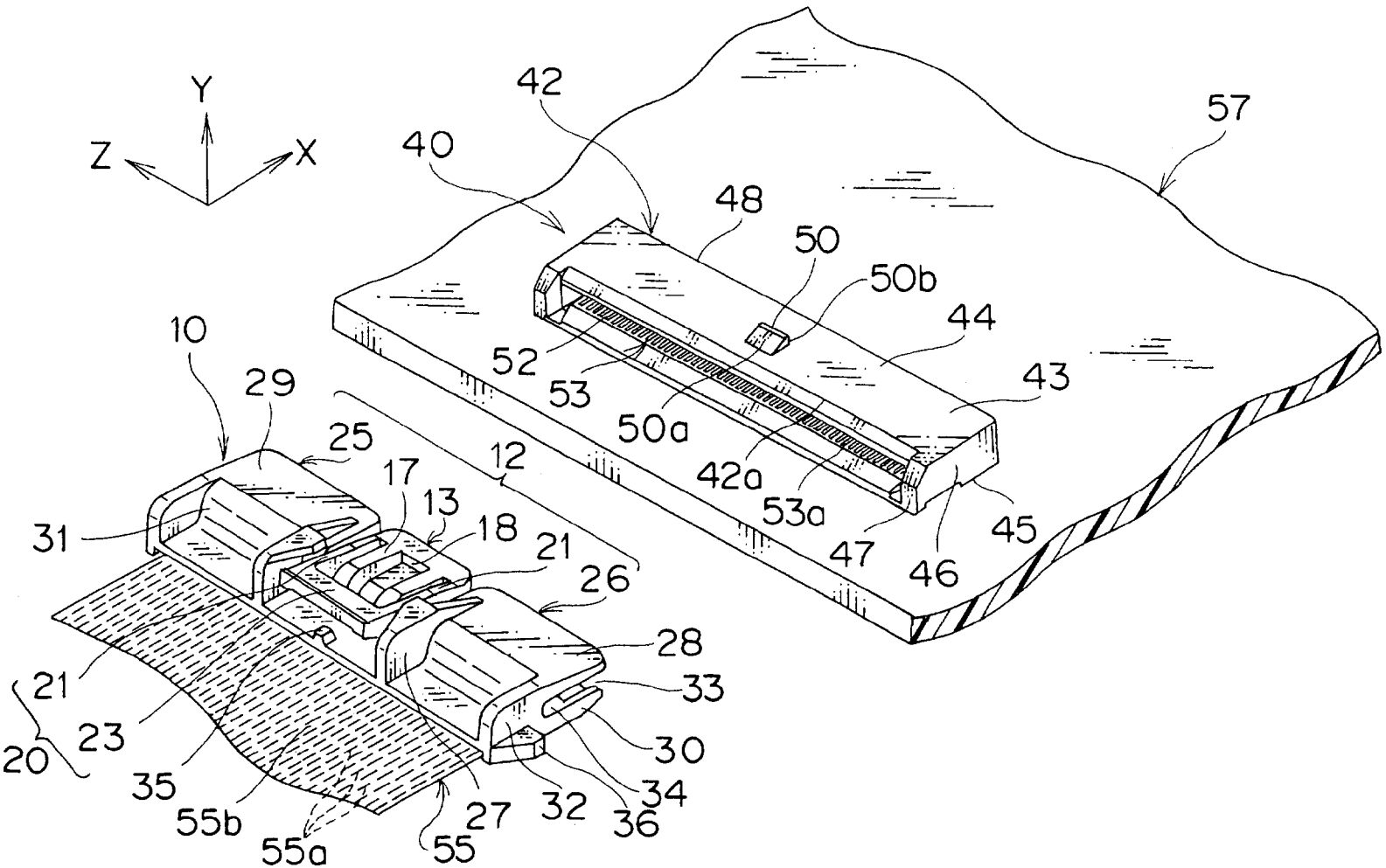
FIG. 1 is a perspective view of a connector locking structure according to a first embodiment of this invention.

Now referring to the drawings, an explanation will be given of various embodiments of this invention.

Embodiment 1

FIGS. 1 to 4 show a connector locking structure according to the first embodiment of this invention.

FIG. 1 shows a male connector (first connector) 10 attached onto a flexible flat cable (FFC) which is a flat circuit body 55 and a female connector (complementary second connector) 40 directly attached to a printed circuit board (PCB) which is a circuit board.

The FFC 55 is a flexible circuit body contiguous to the male connector. The FFC 55 has belt-like wiring conductors 55*a* whose periphery is covered with an insulating coating 55*b*. Incidentally, the flat circuit body may be a flexible printed circuit (FPC). The PCB 57 is a circuit board on which wiring conductors (not shown) are printed. The wiring conductors 55*a* may be busbars (not shown), slender wiring conductors (not shown) formed on an insulating board by insert molding or bonding, or conductive resins.

Now, the male connector 10 refers to a connector in which the flat circuit body such as the FFC 55 is attached to a male connector housing 12. The female connector 40 refers to a connector in which terminals 53 directly attached to circuit board such as the PCB 57 are housed in a female connector housing 42.

The male connector 10 includes the FFC 55 and the male connector housing 12. The FFC 55 is a coated wire for transferring control signals among devices mounted in a motor vehicle in which a plurality of wiring conductors 55*a* are arranged in parallel. The number of the wiring conductors 55*a* corresponds to that of the terminals accommodated in the female connector 40. The coating 55*b* which covers the wiring conductors 55*a* is an "insulating sheet" which is made of polyvinylchloride resin or polyethylene resin.

Figure 2:
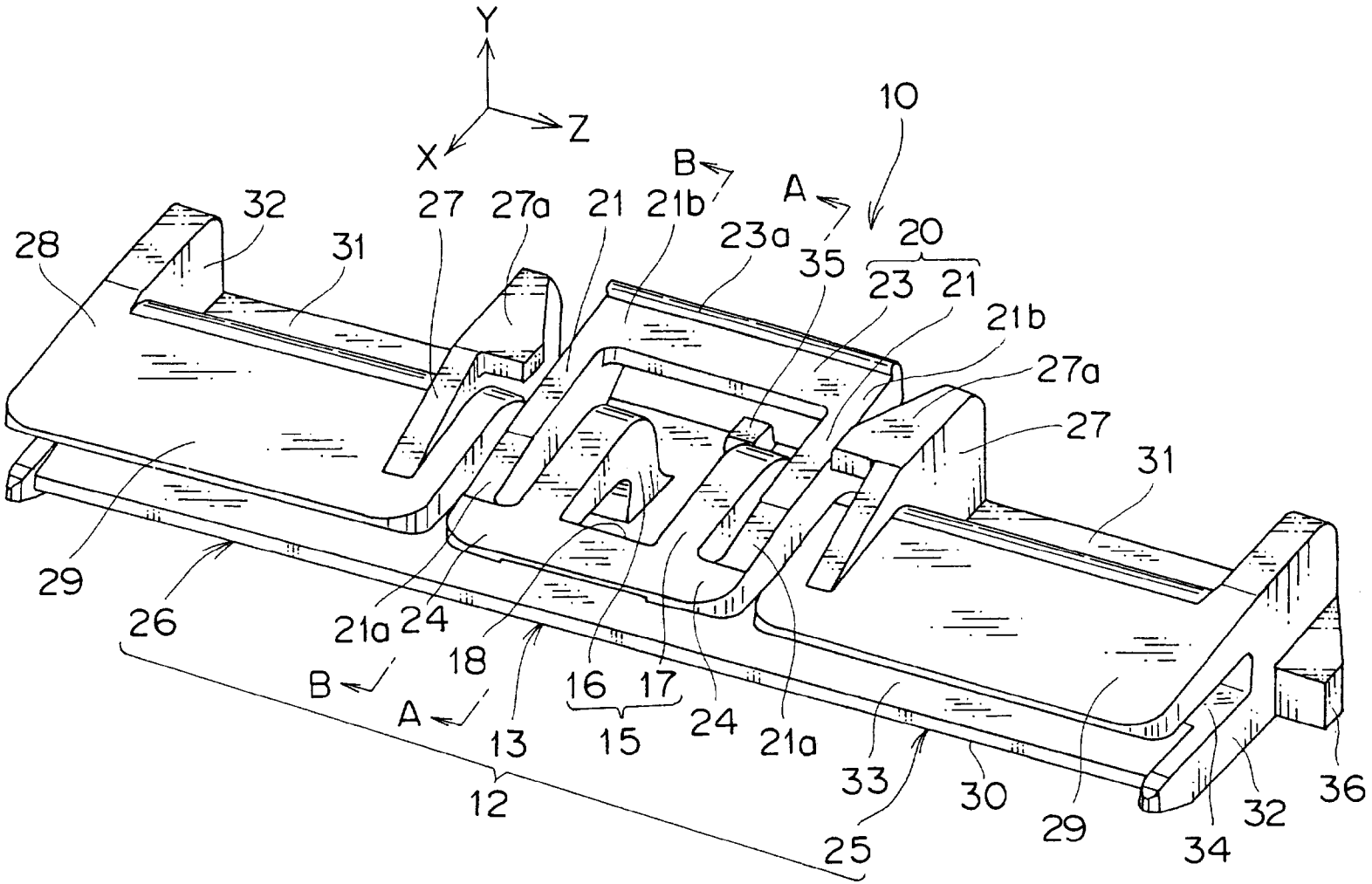
FIG. 2 is a perspective view showing a male connector in the connector locking structure shown in FIG. 1.

As seen from FIG. 2, the male connector housing 12 is made of insulating synthetic resin and molded by injection molding. The male connector housing 12 is made in the form of a box and composed of three regions arranged in a longitudinal direction Z. At the center, a first region 13 having a locking lever 15 is formed On both sides of the center, a second and a third regions 25 and 26 are formed, respectively which permits the outer wall (or wall) of the female connector 40 which is a complementary second connector to be fit. The second and the third region 25 and 26 are formed symmetrically with respect to the first region 13.

The first region 13 is partitioned from the second and the third region 25 and 26 by partition walls 27. The second and the third region 25 and 26 have an opening 33 which penetrates in the longitudinal direction and opens in a coupling direction X orthogonal to the longitudinal direction. On the deep side of the opening 33, a coupling space 34 in which the female connector 40 (FIG. 1) is formed.

The outer wall of the second and the third region 25 and 26 includes an upper wall 29, a lower wall 30 opposite to the upper wall 29, a rear wall 31 (FIG. 1) which communicates with the upper wall 29 and lower wall 30, and both side walls 32. The upper wall 29, lower wall 30 and side walls 32 are formed so as to have flat surfaces. The lower wall 30 extends toward the side of extending the FFC 55. The rear wall (FIG. 1) is formed as a curve. The side wall 32 is provided with a protruding stopper 36 for positioning both connectors 10 and 40 in the fitting direction X.

For convenience of explanation of this embodiment, the front-rear direction (coupling direction) X, upper-lower direction Y and the left-right direction Z are defined as follows. The front-rear direction X refers to a direction of coupling both connectors 10 and 40. The front side is defined as the side of the complementary connector 10, 40. The rear side is defined as the side opposite to the front side. The upper-lower direction Y refers to a direction of the thickness of the FFC 55 or PCB 58. The upper side is defined as the side of the female connector 40 placed on the PCB 57 (FIG. 1). The lower side is defined as the side opposite to the upper side. The left-right direction Z refers to a direction of the male connector housing 1. The left side and right side are not particularly defined since they are symmetrical.

Incidentally, the directions when the male connector 10 and the female connector 40 are actually used does not accord with the directions in this embodiment. For example, the upper side and the lower side may be reversed.

Returning to FIG. 2, the partition walls 27 are formed integrally to the outer wall 28. The partition walls 27 are upright walls located at positions close to the first region. The partition walls 27 are formed in parallel to the side walls 32 on both sides. From the upper portion of each partition wall 27, a protruding wall 27*a* protrudes toward the first region 13 in parallel to the lower wall 30.

The protruding walls 27*a* may be formed to cover both ends of a pressing portion 23. In this case, the protruding walls 27*a* can stop external interference so that a releasing lever 20 is prevented from being pressed inadvertently.

The first region 13 is distinct from the second and the third region 25 and 26. The first region 13 is provided with an engagement (locking) portion 18. When the male connector 10 and the female connector 40 (FIG. 1) are coupled with each other, the first region 13 permits the locking portion 18 and an locking protrusion (engagement portion) 50 to be engaged with each other so that the coupled state of the connectors is held.

The first region 13 is provided with a ⊐-shaped locking lever 15 and a ⊐-shaped releasing lever 20. The locking lever 15 includes a pair of legs 16 (only one of them is illustrated) which are upright from the lower wall 30 and a pair of free ends 17 which communicate with the legs 16 so as to continuously cross them, respectively.

BRIEF SUMMARY OF THE INVENTION

The pair of legs 16 (only one is shown) are upright from a position close to the rear side of the lower wall 30 so that they are apart from and in parallel to each other. Since the pair of legs 16 are located at the position close to the rear side, the protruding length of the locking lever 15 becomes long. This prevents the leg 16 which is a base of the locking lever 15 from suffering concentrated stress and being deformed. In order to improve the strength of the leg 16, the leg 16 may be made thick and wide. But, the locking lever 15 is upsized so that such a measure cannot be adopted under the condition of requiring down-sizing.

Figure 3:
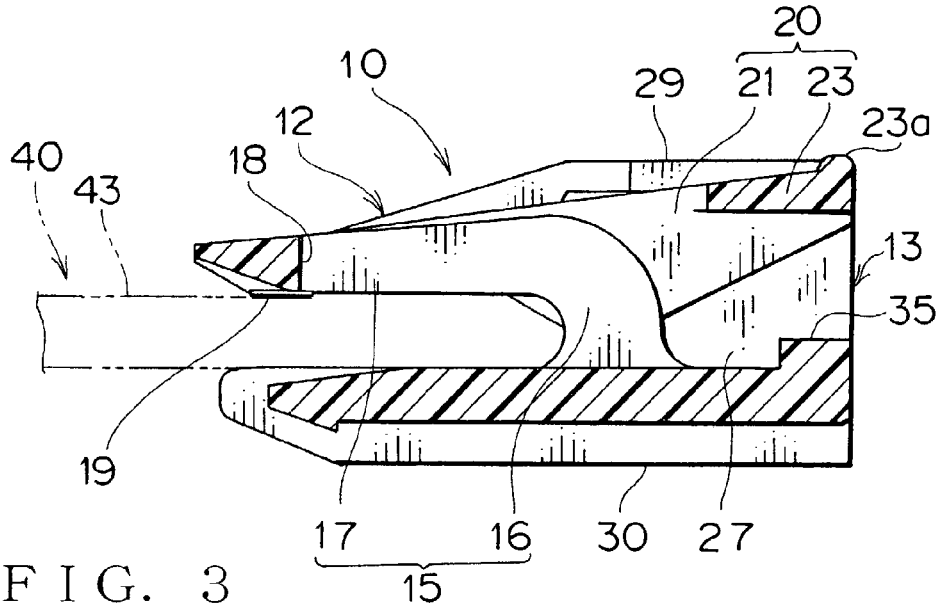
FIG. 3 is a sectional view taken in line A—A in FIG. 2.

The free ends 17 communicate with the legs 16 so as to form an L-shape and gradually slope downwards as they approach the front side (FIG. 3). The tips of the free ends 17 are connected to each other so that the edge in a ⊐-shape forms the engagement portion 18.

Figure 4:
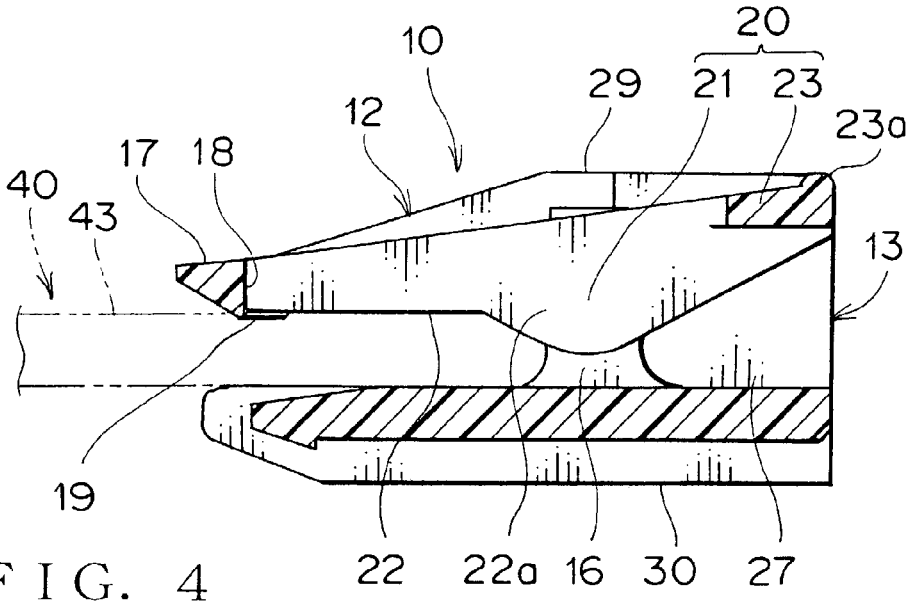
FIG. 4 is a sectional view taken in line B—B in FIG. 2.

As seen from FIGS. 3 and 4, at corners where the free ends 17 intersect arms 21, operating portions 19 are formed to press the outer wall 43 of the female connector 40. The operating areas 19 intend to cause the locking portion 18 to climb over the slope 50*a* of the locking protrusion 50 (FIG. 1) smoothly.

Since the operating regions 19 are formed at the corner portions 24, their contact areas are increased. Therefore, when the connectors are coupled with each other so that the engagement portion 18 and the locking protrusion 50 are engaged with each other, the feeling of click due to the engagement can be obtained. Namely, when the connectors are coupled with each other, the operating portions 19 hit against the outer wall 43 of the female connector 40.

As seen from FIG. 2, the releasing lever 20 is arranged outside the pair of legs 16 so as to surround the outer periphery of the locking lever 15. The releasing lever 20 includes a pair of arms 21 which continuously cross the free end 17 of the locking lever 15 and a pressing portion 23 which crosses to communicate with each arm 21. The releasing lever 20, which is arranged outside the pair of legs 16, is large in size so that its operability is improved.

As described above, the front end 21*a* of the arm 21 communicates with the free end 17 of the locking lever 15 which returns toward the leg 16 and extends rearward beyond the leg 16. The reason why the arm 21 is formed to have such a long span is to operate the releasing lever 20 by the theory of leverage and push up the free end 17 by small force to release the locking. The arm 21 is formed to descend gradually from the rear end 21*b* to the front end 21*a* (FIGS. 3 and 4). In this way, since the arm 21 is caused to descend, the distance between the pressing portion 23 which communicates with the rear end 21*b* and the lower wall 30 is increased so that the push-up margin of the pressing portion 23 can be sufficiently assured.

The respective rear ends 21*b* of the pair of arms 21 are coupled with each other by the pressing portion 23. Since the pressing portion 23 bends inward from the arms 21, the releasing lever 20 is formed in a ⊐-shaped. At the rear end edge of the pressing portion 21, a rib 23*a* which protrudes upward is formed over the entire width of the pressing portion 21. Therefore, when the pressing portion 23 is pressed by a finger, slippage of the finger tip is prevented, thereby improving the operability of the releasing lever 20.

As seen from FIG. 4, at the center on the lower surface (inner surface) of the arm 21, a protruding portion 22*a* which serves as a hitting portion which hits against the sloped front end 42*a* of the female connector 40 is provided. This protruding portion 22*a* is convex downward. Therefore, when the releasing lever 20 is depressed, the protruding portion 22*a* hits against the sloped front end 42*a* and operates as a fulcrum of leverage. Thus, by depressing the pressing portion 23, the front end 21*a* (FIG. 2) of the arm 21 is pushed up.

The hitting portion which serves as a fulcrum of leverage should not be limited to the convex protruding portion 22*a*. However, by using the theory of leverage, the engagement between the engagement portion 18 and the locking protrusion 50 (FIG. 1) can be surely released.

As seen from FIG. 3, a protrusion 35 for limiting warp is formed on the upper surface of the lower wall 30 opposite to the pressing portion 23. The protrusion 35 is located oppositely to the center of the pressing portion 23 (FIG. 2). The protrusion 35 is centered to prevent the pressing portion 23 from inclining in either direction of left and right.

Because of provision of the protrusion 35, when the pressing portion 23 is depressed, the lower surface of the pressing portion 23 is brought into contact with the apex of the protrusion 35. This stops excessive elastic deformation of the releasing lever 20, thereby preventing the damage of the releasing lever 20.

Returning to FIG. 1, an explanation will be given of the female connector 40 which is a complimentary connector.

The female connector 40 includes a female connector housing 42 having a coupling space and terminals 53 which are directly anchored to the PCB 57. The outer wall 43 of the female connector housing 42 includes an upper wall 44 and a lower wall 45, both side walls 46 (only one of them is shown) which communicate with the left and right ends of the upper wall 44 and lower wall 45, a front wall 47 with an opening and a rear wall 48 opposite to the front wall 47.

At the center on the upper wall 44, a locking protrusion 50 which is engaged with the engagement portion 18 of the male connector 10 is formed. The locking protrusion 50 has a slope 50*a* over which the locking portion 18 climbs and a locking face 50*b* continuous to the slope 50*a*. Since the locking portion 18 of the male connector 10 is coupled with the locking protrusion 50, the coupling state of the connectors is held.

The lower wall 30 of the male connector 10 is inserted in the coupling space 52. The upper wall 29 of the male connector 10 overlies the upper wall 44 of the female connector 40. Specifically, the upper wall 44 of the female connector 40 is sandwiched between the upper wall 29 and the lower wall 30 of the male connector 10 so that both connectors are coupled with each other.

The terminals 53 are embedded in the lower wall 45 of the female connector 40. The electric contacts 53*a* of the terminals 53 are exposed from the inner face of the lower wall 45. The electric contacts 53*a* are connected to the wiring conductors 55*a* of the FFC 55 so that control signals are transferred from the male connector 10 to the female connector 40.

Embodiment 2

Figure 5:
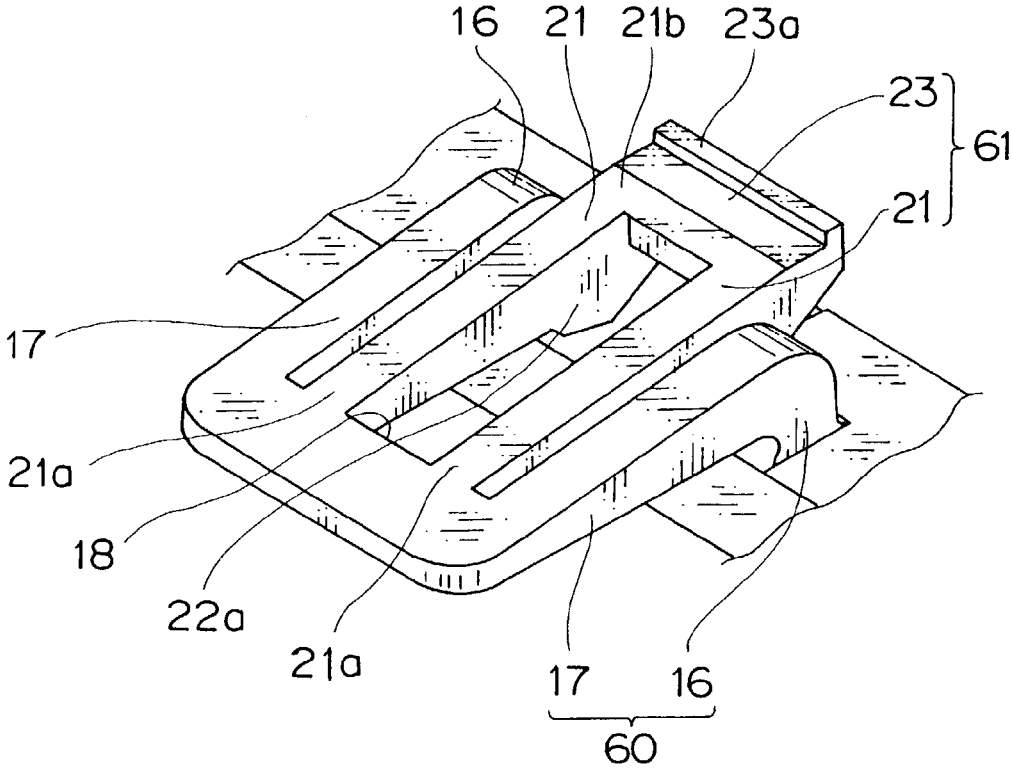
FIG. 5 is a sectional view of the connector locking structure according to a second embodiment of this invention.

FIG. 5 shows the connector locking structure according to a second embodiment of this invention. As seen from FIG. 5, a locking lever 60 and a releasing lever 61 are illustrated. In this embodiment, like reference numerals refer to like elements in the first embodiment.

This embodiment is different from the first embodiment in that the releasing lever 61 is arranged inside the pair of legs 16 of the locking lever 60. The remaining configuration is the same as that in the first embodiment. In accordance with this embodiment, since the releasing lever 61 is arranged inside the legs 16, the releasing lever can be downsized.

Embodiment 3

This embodiment intends to provide a connector locking structure which can surely make coupling/decoupling between the connectors without large-scaling the locking portion (which corresponds to the first region 13 in FIG. 1).

Figure 8:
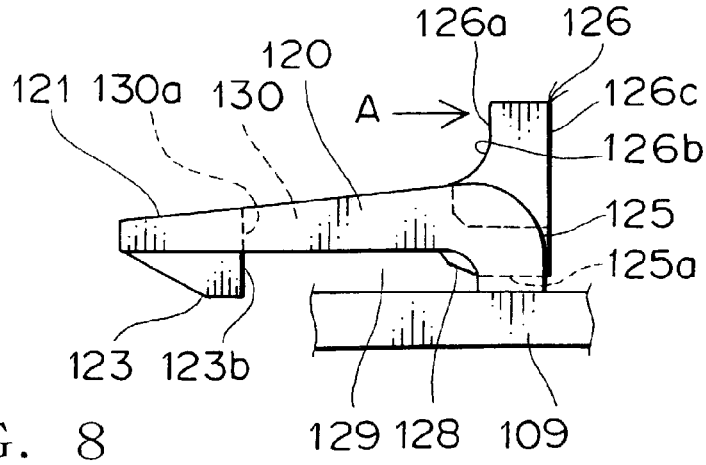
FIG. 8 is a sectional view of the locking portion.
Figure 6:
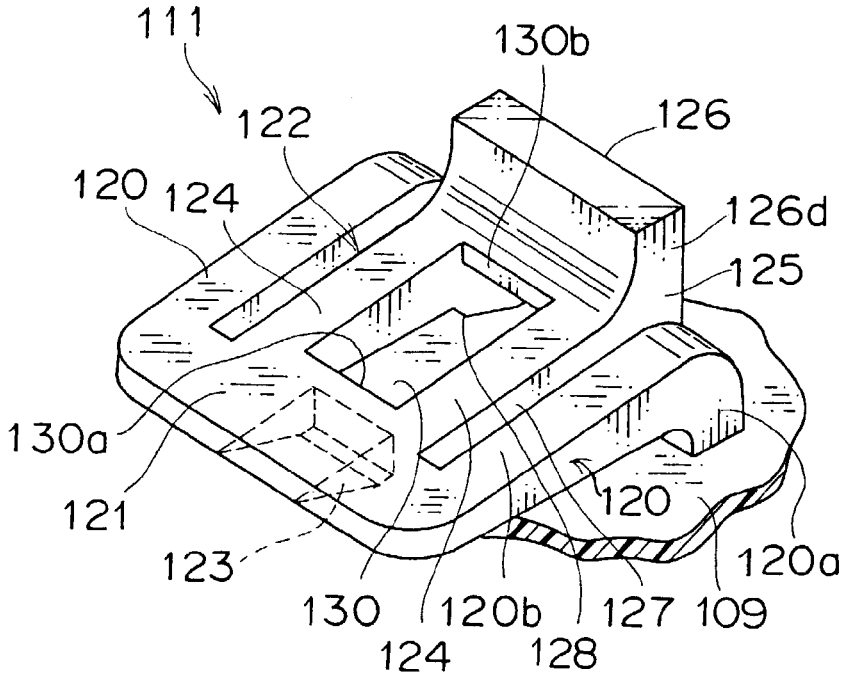
FIG. 6 is an enlarged perspective view of a locking portion according to a third embodiment of this invention.
Figure 7:
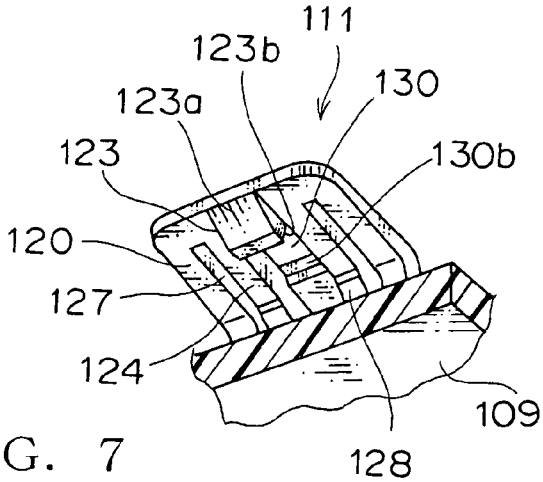
FIG. 7 is a perspective view of the locking portion when viewed from the inside.
Figure 9:
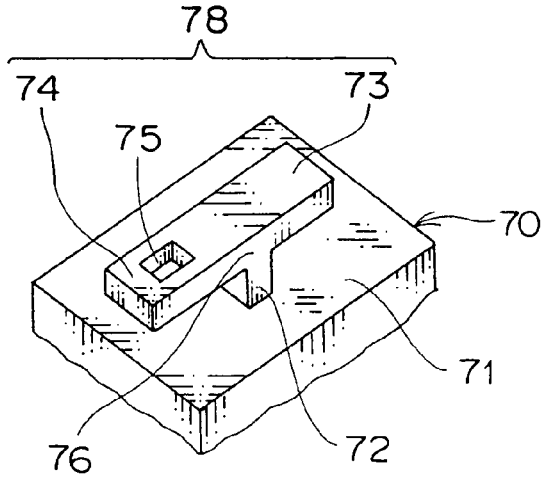
FIG. 9 PRIOR ART
FIG. 9 is a perspective view of a conventional connector locking structure.
Figure 10:
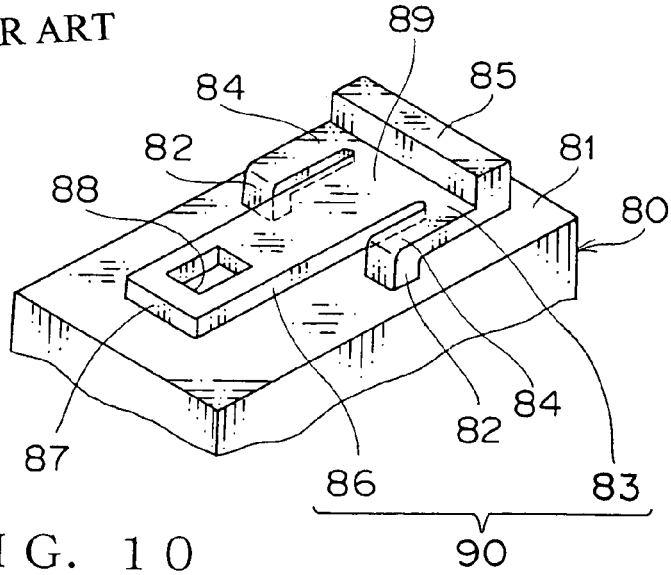
FIG. 10 PRIOR ART
FIG. 10 is a perspective view of another conventional connector locking structure.

FIGS. 6 to 8 show the connector locking structure according to a third embodiment of this invention.

As seen from an enlarged perspective view of FIG. 6, a locking portion 111 includes a pair of first left and right resilient arms 120 which are upright in an L-shape from a horizontal base plate 109, a coupling plate (portion) 121 which couples the front ends of the arms 120 with each other in the widthwise direction, and an operating portion 122 in a frame form which is extended rearward between the pair of arms 120 from the coupling plate 121 to the positions of the arm bases 120*a* of the pair of arms 120.

The arms 120 each includes a short vertical leg 120*a* which is an upright base and a long horizontal resilient leg 120*b*. The coupling plate 121 is formed with a wide width to have a length approximately equal to the length of the arm 120. As also seen from FIG. 7, a protrusion 123 is formed on the lower surface of the coupling portion 121. The protrusion 123 has a front slope 123*a* for sliding and a rear vertical locking face 123*b*.

The operating piece 122 (FIG. 6) includes a pair of second resilient arms 124 which are continuous to the coupling portion 121, a coupling portion 125 which couples the rear (free) ends of the pair of second arms 124 in the widthwise direction of the locking portion and an operating portion 126 which protrudes upward from the coupling portion 125.

The pair of second arms 124 are extended in parallel to the outer first arms 120 and in a direction opposite to the extending direction of the first arms 120. The upper surfaces of the first and second (inner and outer) arms 120 and 124 slope so as to increase their thickness gradually toward the rear side. The lower surfaces of the first and second arms 120 and 124 are in parallel to the upper surface of the base plate 109. The upper wall 44 of the female connector housing 42 of the female connector 40 (FIG. 1) can enter between the first and second arms 120, 124 and the base plate 109.

A square hole 130 is formed to be surrounded by the coupling plate 121 (FIG. 6), pair of inner (second) arms 24 and coupling portion 125. As seen from FIG. 8, the front end 130*a* of the hole 130 is flush with the locking face 123*b* of the protrusion 123 on the lower surface of the coupling plate 121. The protrusion 123 and hole 130, or at least the protrusion 123 is coupled with the locking protrusion 50 of the female connector 40 (FIG. 1). The locking protrusion 50 has a front slope 50*a* for sliding and a rear vertical locking face 50*b* continuous to the slope 50*a*. In FIG. 6, a slit 127 between the first and second (outer and inner) arms 120 and 124 extends to a position slightly more front than the front end 130*a* of the hole 130. In the specification, the direction of connector coupling is defined as "front".

The rear end 130*b* of the hole 130 is continuous to the lower surface 125*a* (FIG. 8) of the coupling portion 125. The coupling portion 125 is located above and apart from the base plate 109. The bases (rear ends)of the pair of inner arms 124 on both sides of the coupling portion 25 slope downward toward the base plate 109. This slope 128 (FIG. 8) is continuous to the lower surface 125*a* of the coupling portion 25 which is substantially horizontal and slightly apart from the base plate 109. The slope 128 can be brought into contact with the sloped front end 42*a* of the upper wall 44 of the female connector housing 40 so that it operates as a contact furculum for the upper wall 44. The rear ends of the inner arms 24 (FIG. 6) and the coupling portion 25 constitute a free end of the operating piece 22. As seen from FIG. 8, the slopes 128 of the inner arms 124 are located at a position more front than the operating portion 126. The free end of the operating piece 122 (FIG. 6) is located at the same position as the legs 120*a* of the outer arms 120, and does not largely protrude rearward. For this reason, the locking portion 111 is made compact in the longitudinal direction.

The coupling portion 125 is continuous to the operating portion 126 which extends upward. The operating portion 126 protrudes at a height of the total of the protrusion 123 and the hole 130. The front end face of the operating portion 126 is composed of an upper vertical face 126*a* and a lower curved face 126*b*. The curved face 126*b* is continuous to the upper surfaces of the inner arms 122 (FIG. 6). The rear end face 126*c* (FIG. 8) of the operating portion 126 is vertically flush with the rear end face of the coupling portion 125. The vertical side faces 126*d* (FIG. 4) of the operating portion 126 are continuous to both side surfaces of the pair of arms 124. The operating portion 126 is located at a position more rear than the slopes 28 of the pair of inner arms 124. As indicated by arrow A in FIG. 8, the operating portion is rearward pressed in a substantially horizontal direction.

Referring to FIGS. 1 and 6 to 8, an explanation will be given of the operation of the connector locking structure described above.

In coupling both connectors 10 and 40 with each other (FIG. 1), the protrusion 50 of the female connector 40 upward warps the outer arms 120 of the locking portion 18 as well as the inner arms 124 thereof as one body at a fulcrum of the legs 20 while the protrusion 50 is being brought in slidable contact with the protrusion of 123 (FIG. 6) of the locking portion 111 of the male connector 10. Simultaneously when the connectors have been coupled with each other, the arms 120 and 124 are restored to their state oriented downward to that the protrusions 123 and 50 are engaged with each other at their locking faces 123*b* and 50*b*. Thus, both connectors 10 and 40 are firmly coupled with each other. The outer arms 124 moves up and down unitarily with the inner arms 120. The legs 120*a* of the outer arms 120 operate as a first fulcrum whereas at least the protrusion 123 or the protrusion 123 and hole 130 operates as an operating point.

The upper wall 44 of the female connector housing 42 (FIG. 1) has entered the space 29 between the inner and outer arms 124, 120 and the base plate 109 (FIG. 8), and the sloped front end 42*a* of the female connector 40 is brought into contact with the slopes 128 of the inner arms 124 (FIGS. 3 and 4). Thus, when the coupling of both connectors is decoupled, the operating piece 122 (FIG. 8) of the locking portion 111 can rotate upward at a furculum of the slope 28. The slopes 128 of the inner arms 124 operates as a second furculum. This is because the operating portion 126 is located at a position slightly more rear than the slopes 128 (i.e. the slopes 128 are located at a position slightly more front than the operating portion 126.

Where the coupling between both connectors 10 and 40 is released, when an operator pulls the operating portion 126 rearward by a finger, the inner arms 124 rotate upward at the furculum of the slope 128. The coupling portion 121 and the outer arms 120 continuous thereto also rotate upward unitarily with the inner arms 124. Thus, the protrusion 123 on the lower surface of the coupling portion 121 is disengaged from the protrusion 50 of the complimentary female connector 40. In this case, the operating portion 26 operates as a power point.

Particularly, since the slit 27 (FIG. 6) between the inner and outer arms is recessed to a position more front than the front end 130*a* of the hole 130 (locking face 123*b* of the protrusion 123), when the operating portion 126 is pulled, the inner arms 124 largely warp upward so that the protrusions 123 and 50 are easily and surely disengaged. By pulling out the male connector 10 rearward with the operating portion 126 pulled rearward, the coupling between both connectors 10 and 40 are released. Since the direction of operating the operating portion (arrow A is the same as that of releasing the male connector 10, the connector 10 can be easily separated from the female connector 40 while the operating portion 126 is being pulled.

Unlike the conventional cantilever arm, the locking portion 11 according to this embodiment is so designed that the outer arms 120 extend from the first furculum's (FIG. 6) and the inner arms 124 U-turn. Therefore, even when the power point is provided above the fulcrums 120*a*, a sufficient locking distance (warping distance) can be obtained, thereby assuring the down sizing of the locking portion 11 and coupling/decoupling of both connectors.

Even where the front end of the upper wall 44 of the female connector housing 42 (FIG. 1) does not have the slope 42*a*, the front end edge (not shown) of the upper wall 44 is brought into contact with the slopes 128 of the inner arms 124 so that the slopes 128 serve as the second fulcrum. Thus, by pulling the operating portion 126 or pushing it from the front, the locking portion 111 can be rotated in the connector decoupling direction. Where the inner arms 124 have the slopes 128, the front end edge of the female connector housing 42 is brought into contact with the inner face at the intermediate point of the inner arms 124 in the longitudinal direction so that the intermediate point serves as the second fulcrum, thereby releasing the connector coupling.

Incidentally, in this embodiment, the first arms 120 are arranged outside whereas the second arms 124 are arranged inside. An arrangement can be proposed in which the first arms (120) are arranged inside, the second arms (124) are arranged outside through the coupling plate portion 121 at the free ends of the first arms 120, the free ends (rear ends) of the second arms 24 are coupled with each other by the coupling portion 125 whose width is wider than the distance between the first arms 120, and the operation portion (126) is integrally formed on the coupling portion (125). This format may be slightly enlarged in the longitudinal direction because the coupling portion 125 protrudes rearward as compared with the format as shown in FIG. 4. However, by protruding the coupling portion (125) upward on both sides of the bases (120*a*) of the inner (first) arms (120) to provide the operating portion 126, thereby preventing the locking portion from being enlarged.

In FIG. 6, the outer arms may be formed in e.g. two pairs but not one pair. The protrusion 123 for locking may be removed (the protrusion 50 of the female connector 40 may be required) so that the protrusion 50 of the female connector 40 is engaged with the hole 30. In this case, the locking face 30*a* of the front end of the hole 130 serves as a locking portion. Further, the curved face 126*b* (FIG. 8) of the operating portion 126 may be cancelled to provide a right crossing face. The locking portion 11 in FIG. 6 may be partitioned in two parts at the center in the widthwise direction to provide the locking portion including a single outer arm and a single inner arm and a single outer arm for each part.

In the embodiment described above, although the locking potion is provided in the male connector, it may be provided in the female connector.

Finally, it should be noted that the contents of Japanese Patent Application Nos. 2002-111614 and 2002-112952 are hereby incorporated by reference.

What is claimed is:

1. A connector locking structure for holding the coupled state of first and second complementary connectors each equipped with an engagement portion, wherein said first connector comprises:

a connector housing having a lower wall, and an upper wall opposite to the lower wall, the upper wall not extending over the engagement portion, and a rear wall which communicates with the upper wall and the lower wall;

a locking lever including a pair of legs upright from said lower wall of the first connector and a pair of free ends which continuously cross the pair of legs and coupled with each other to provide said engagement portion; and a releasing lever extending from the free ends in a direction of the pair of legs, wherein the second connector is fit between the lower and upper walls of the first connector and the engagement portion thereof and when said releasing lever is depressed, a hitting portion of said releasing lever hits against a front end of the second connector and operates as a fulcrum of leverage so that said free ends are lifted, thereby releasing the locked state of said engagement portion.

2. A connector locking structure according to claim 1, wherein said hitting portion is a portion which protrudes downward.

3. A connector locking structure according to claim 1, wherein said releasing lever includes a pair of arms arranged outside or inside said pair of legs and a depressing portion which continuously crosses said pair of arms.

4. A connector locking structure according to claim 3, wherein said pair of arms extend beyond said pair of legs in a direction opposite to a connector coupling direction.

5. A connector locking structure according to claim 4, wherein at corners where said free ends intersect said releasing lever, a pair of operation portions are formed to press the outer wall of the second connector.

6. A connector locking structure according to claim 1, wherein said engagement portion of the first connector is an edge in a ⊐-shape formed by said free ends and said engagement portion of the second connector is a locking protrusion composed of a slope and locking face continuous thereto.

7. A connector locking structure provided with a locking portion formed in a first connector and a portion-to-be-locked formed in a second connector so that both connectors are locked with each other simultaneously when they are coupled with each other, wherein said locking portion comprises:

a first arm which is upright from a lower wall of said first connector with said first connector having a housing with the lower wall, and an upper wall opposite to the lower wall, the upper wall not extending over the locking portion, and a rear wall which communicates with the upper wall and the lower wall;

a second arm which extends from a free end of said first arm toward an upright base of said first arm and has a contact fulcrum on a wall of said second connector;

an engagement portion located on the side of said free end of said first arm; and an operating portion for locking releasing which is upright on the side of the free end of said second arm, wherein said first arm is one of a first pair of arms coupled with each other through a first coupling portion, said second arm is one of a second pair of arms coupled with each other, and said operating portion is formed upright on a second coupling portion.

8. A connector locking structure according to claim 7, wherein said first arm and said second arm have approximately equal lengths and said operating portion is located beside and above an upright base.

9. A connector locking structure according to claim 7, wherein a slit formed between the first and second arms extends toward the free end of said first arm beyond said engagement portion.

10. A connector locking structure according to claim 7, wherein said contact fulcrum is a slope.

11. A connector locking structure according to claim 7, wherein said first pair of arms are located outside whereas said second pair of arms are located inside.

* * * * *